US008172080B1

(12) United States Patent
Schantz

(10) Patent No.: US 8,172,080 B1
(45) Date of Patent: May 8, 2012

(54) BOX FOR SALE OF BELTS

(75) Inventor: Amanda Schantz, Chicago, IL (US)

(73) Assignee: Randa Accessories Leather Goods, LLC, New York, NY (US)

( * ) Notice: Subject to any disclaimer, the term of this patent is extended or adjusted under 35 U.S.C. 154(b) by 450 days.

(21) Appl. No.: 12/557,213

(22) Filed: Sep. 10, 2009

(51) Int. Cl.
*B65D 85/18* (2006.01)

(52) U.S. Cl. ..... 206/278; 206/408; 206/296; 206/292; 206/781

(58) Field of Classification Search ..... 229/162.1, 229/162.7; 206/388, 278, 292–297, 299, 206/781, 408
See application file for complete search history.

(56) References Cited

U.S. PATENT DOCUMENTS

| | | | | |
|---|---|---|---|---|
| 1,463,948 | A | | 8/1923 | Geimer |
| 1,691,937 | A | * | 11/1928 | Peter ..... 206/296 |
| 1,697,880 | A | | 1/1929 | Peter |
| 2,034,809 | A | | 3/1936 | Grant |
| 2,162,089 | A | | 6/1939 | Kagen |
| 2,290,104 | A | | 7/1942 | Larson |
| 2,442,979 | A | | 6/1948 | Larson |
| 2,464,951 | A | | 3/1949 | Stengren |
| 2,576,070 | A | | 11/1951 | Howard |
| 2,681,174 | A | | 6/1954 | Bergstein |
| 2,700,456 | A | | 1/1955 | Gillam |
| 2,767,831 | A | | 10/1956 | Brecht |
| 2,806,590 | A | | 9/1957 | Larson |
| 2,847,117 | A | | 8/1958 | Vuillemenot |
| D190,772 | S | | 6/1961 | Cuyler |
| 3,033,357 | A | | 5/1962 | Vogel |
| 3,044,605 | A | | 7/1962 | Clement |
| 3,057,466 | A | | 10/1962 | Blonder et al. |
| 3,587,840 | A | * | 6/1971 | Hultberg ..... 206/395 |
| D227,351 | S | | 6/1973 | Winton |
| 3,865,233 | A | | 2/1975 | Hamlin |
| 4,258,842 | A | * | 3/1981 | Falkstein ..... 206/8 |
| 4,320,829 | A | | 3/1982 | DiMarzio et al. |
| D268,649 | S | * | 4/1983 | Adamson et al. ..... D9/416 |
| 4,415,078 | A | | 11/1983 | Hart |
| 4,570,794 | A | * | 2/1986 | Capitao, Jr. ..... 206/394 |
| 4,802,577 | A | | 2/1989 | O'Leary |
| D304,907 | S | * | 12/1989 | Tamsen et al. ..... D9/418 |
| 4,925,088 | A | | 5/1990 | Ostrander |
| D309,262 | S | | 7/1990 | Coiner |
| D314,914 | S | | 2/1991 | Callinan |
| 5,053,811 | A | * | 10/1991 | Watabe et al. ..... 355/72 |
| 5,058,733 | A | | 10/1991 | Lowe |
| 5,058,740 | A | | 10/1991 | Coursen |
| D337,269 | S | | 7/1993 | Grieco |
| D359,233 | S | | 6/1995 | Verhagen |
| D360,131 | S | | 7/1995 | Tudor |
| 5,447,230 | A | | 9/1995 | Gerondale |
| D365,517 | S | | 12/1995 | Bedford et al. |
| D387,983 | S | | 12/1997 | Lanoie |

(Continued)

*Primary Examiner* — Tri Mai
(74) *Attorney, Agent, or Firm* — Caesar, Rivise, Bernstein, Cohen & Pokotilow, Ltd.

(57) ABSTRACT

A box for a pair of belts having a top wall, bottom wall, a plurality of side walls disposed between the top wall and the bottom wall, and an aperture on at least one of the side walls extending to an edge thereof contiguous with an aperture in the top wall to expose a portion of at least one belt of the pair of belts, whereby at least one of the pair of belts is exposed for a user to feel through said aperture in the side wall and said aperture in the top wall.

7 Claims, 4 Drawing Sheets

U.S. PATENT DOCUMENTS

| | | | |
|---|---|---|---|
| 5,813,523 | A | 9/1998 | Gnadt et al. |
| D412,114 | S | 7/1999 | Hansen |
| D419,440 | S | 1/2000 | Hansen |
| D422,498 | S | 4/2000 | Froehlich et al. |
| D423,346 | S | 4/2000 | Froehlich et al. |
| D436,313 | S | 1/2001 | Joshua et al. |
| D438,378 | S | 3/2001 | Charness |
| D441,647 | S | 5/2001 | Humphrey |
| D446,113 | S | 8/2001 | Steinfels |
| D449,523 | S | 10/2001 | Kaplan |
| 6,360,867 | B1 | 3/2002 | Ford et al. |
| D455,552 | S | 4/2002 | Charness |
| 6,460,703 | B1 | 10/2002 | Thompson et al. |
| D466,406 | S | 12/2002 | Solland |
| D497,804 | S | 11/2004 | Hetzel et al. |
| 7,000,775 | B2 | 2/2006 | Gelardi et al. |
| D518,291 | S | 4/2006 | Zou et al. |
| D534,419 | S | 1/2007 | Hermkens et al. |
| D563,218 | S | 3/2008 | DeMalsche et al. |
| 7,392,900 | B2 | 7/2008 | Semel |
| D577,286 | S | 9/2008 | Sheppard et al. |
| D600,110 | S | 9/2009 | Cain |
| D600,547 | S | 9/2009 | Cain |
| D604,602 | S | 11/2009 | Kohno |
| 2005/0023335 | A1 | 2/2005 | Rasmussen et al. |
| 2007/0017843 | A1 | 1/2007 | Keel et al. |

* cited by examiner

BOX FOR SALE OF BELTS

BACKGROUND OF THE INVENTION

The present invention is directed to a box for sale of items. More particularly, the present invention is directed to a box for retail display and sales of belts.

Numerous boxes for sales of belts and other apparel exist in the prior art. For example, U.S. Pat. No. 1,463,948 (Geimer) is directed to a belt box that has a bottom container portion and a lid portion. The belt is disposed in a coiled up configuration within the box. The bottom portion and the lid portion each have an aperture in a side edge thereof which align with one another to expose the buckle from the belt.

U.S. Pat. No. 2,442,979 (Larson) is directed to a oval-shaped package for a belt where, again, the belt is disposed in a coiled configuration. While the top and bottom of the box are paperboard, the side of the package is made from a transparent, flexible material so that the belt in the package may be seen.

U.S. Pat. No. 2,576,070 (Howard) is directed to a package for a belt that is also generally oval-shaped with sides constructed from a transparent material.

U.S. Pat. No. 2,806,590 (Larson) is directed to a belt package that, again, is generally oval in shape. The package telescopes to accommodate different widths of belts.

U.S. Pat. No. 2,847,117 (Vuillemenot) is directed to a hinged box for display of apparel. Two portions of the box are hinged such that one portion telescopes into the other portion.

U.S. Pat. No. 3,044,605 (Clement) is directed to a display box for a belt that includes a transparent top portion and an opaque bottom portion made from paperboard. The transparent portion allows a potential purchaser to view the belt.

U.S. Pat. No. 4,802,577 (O'Leary) is directed to a cylindrical display container for a plurality of belts, each displayed in a coiled configuration. A hollow cylinder is formed from a transparent material. Upper and lower end caps are provided for closing the upper and lower ends of the cylinder. A central spacer is disposed within the cylinder and includes a slot extending radially inwardly from a flattened face portion. The belt buckles are inserted and secured to the slot portion.

U.S. Design Pat. No. D455,552 (Charness) is directed to a design for a belt case that is cylindrical in shape having a clear pane in its top to view a single belt and a pillar about which the belt is wrapped.

U.S. Design Pat. No. D438,378 (Charness) is directed to a similar design to that of U.S. Design Pat. No. D455,552, but the overall shape of the case is oval and the design is made to hold two belts rather than one belt.

U.S. Pat. No. 5,058,733 (Lowe) is directed to a display case for a martial art belt. A rectangular housing for a buckle-less belt has an open front and a centrally mounted post. The belt is displayed in a coiled condition and is held in position by the post.

Additionally, in sales of products, it is beneficial for both cost and logistics to ship, display and sell products from pallets. Member-only warehouse clubs such as Costco, Sam's Club, BJ's Warehouse and the like provide buyers, including individuals and businesses, substantial price savings by selling goods directly from pallets. Stores of this type often require display of the goods they are selling to be delivered from suppliers on shipping pallets to reduce their costs by eliminating the labor of unpacking goods from pallets and displaying them for purchasers. In this way, cost savings can be passed on to purchasers All references cited herein are incorporated herein by reference in their entireties.

BRIEF SUMMARY OF THE INVENTION

In the past, men's belts have not been sold on pallets in that they are typically sold in a hanging fashion from hangers such that buyers can inspect and feel the quality of the leather, the buckle, etc. It believed that, to date, belts have not been sold by any large warehouse clubs due to the difficulty in displaying such belts in a desirable, but prepackaged manner. The present invention, as described herein, makes sales of belts on pallets to warehouse stores and the like possible by providing a packaging concept for belts that is conducive to sales on pallets.

In a first preferred embodiment of the present invention, a box for a pair of belts is provided, the box having a top wall, a bottom wall, a plurality of side walls disposed between the top wall and the bottom wall, and an aperture on at least one of the side walls extending to an edge thereof, contiguous with an aperture in the top wall, to expose a portion of at least one of the pair of belts. At least one of the pair of belts is exposed for a user to feel through the aperture in the side wall and the aperture in the top wall.

An upper formed spacer and a lower formed spacer may be included where the upper formed spacer has a raised protuberance to support an upper belt of the pair of belts in a coiled condition, and the lower formed spacer has a raised protuberance to support a lower belt of the pair of belts in a coiled condition. A middle formed spacer may be disposed in the box between the upper formed spacer and the lower formed spacer to separate the upper belt from the lower belt. A depression formed in the lower formed spacer may be included to support a buckle of the lower belt. At least one raised protuberance in the middle formed spacer may be included to assist in preventing the lower belt from uncoiling. The upper formed spacer and the lower formed spacer may each have raised corner members, wherein the raised corner members of the upper formed spacer abut the middle spacer and the raised corner members of the lower formed spacer abut the middle spacer.

In a second, more detailed embodiment of the present invention, a box for a pair of belts is provided which includes a top wall, a bottom wall, a plurality of side walls disposed between the top wall and the bottom wall, an aperture on at least one of the side walls extending to an edge thereof contiguous with an aperture in the top wall to expose a portion of at least one belt of the pair of belts, and an upper formed spacer and a lower formed spacer, the upper formed spacer having a raised protuberance to support an upper belt of the pair of belts in a coiled condition, and the lower formed spacer having a raised protuberance to support a lower belt of the pair of belts in a coiled condition. The upper formed spacer and the lower formed spacer each have raised corner members, wherein the raised corner members of the upper formed spacer abut the middle spacer and the raised corner members of the lower formed spacer abut the middle spacer. At least one of the pair of belts is exposed for a user to feel through said aperture in the side wall and the aperture in the top wall. A middle formed spacer may be disposed in the box between the upper formed spacer and the lower formed spacer to separate the upper belt from the lower belt. A depression may be formed in the lower formed spacer to fit a buckle of the lower belt. At least one raised protuberance in the middle formed spacer may be included to assist in preventing the lower belt from uncoiling.

BRIEF DESCRIPTION OF SEVERAL VIEWS OF THE DRAWINGS

The invention will be described in conjunction with the following drawings in which like reference numerals designate like elements and wherein.

DETAILED DESCRIPTION OF THE INVENTION

The invention will be illustrated in more detail with reference to the following embodiments, but it should be understood that the present invention is not deemed to be limited thereto.

Figure 1:
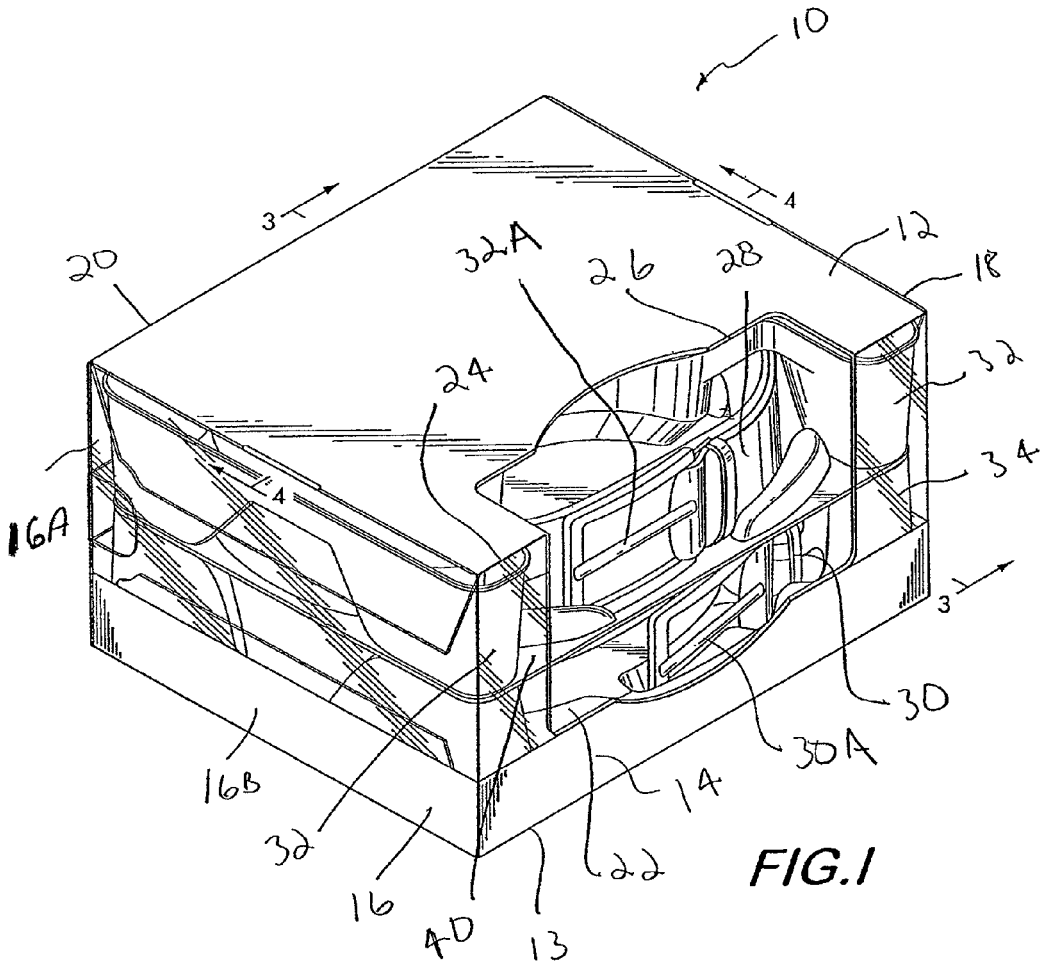
FIG. 1 is an isometric view of a box for the sale of belts in accordance with a first preferred embodiment of the present invention.
Figure 2:
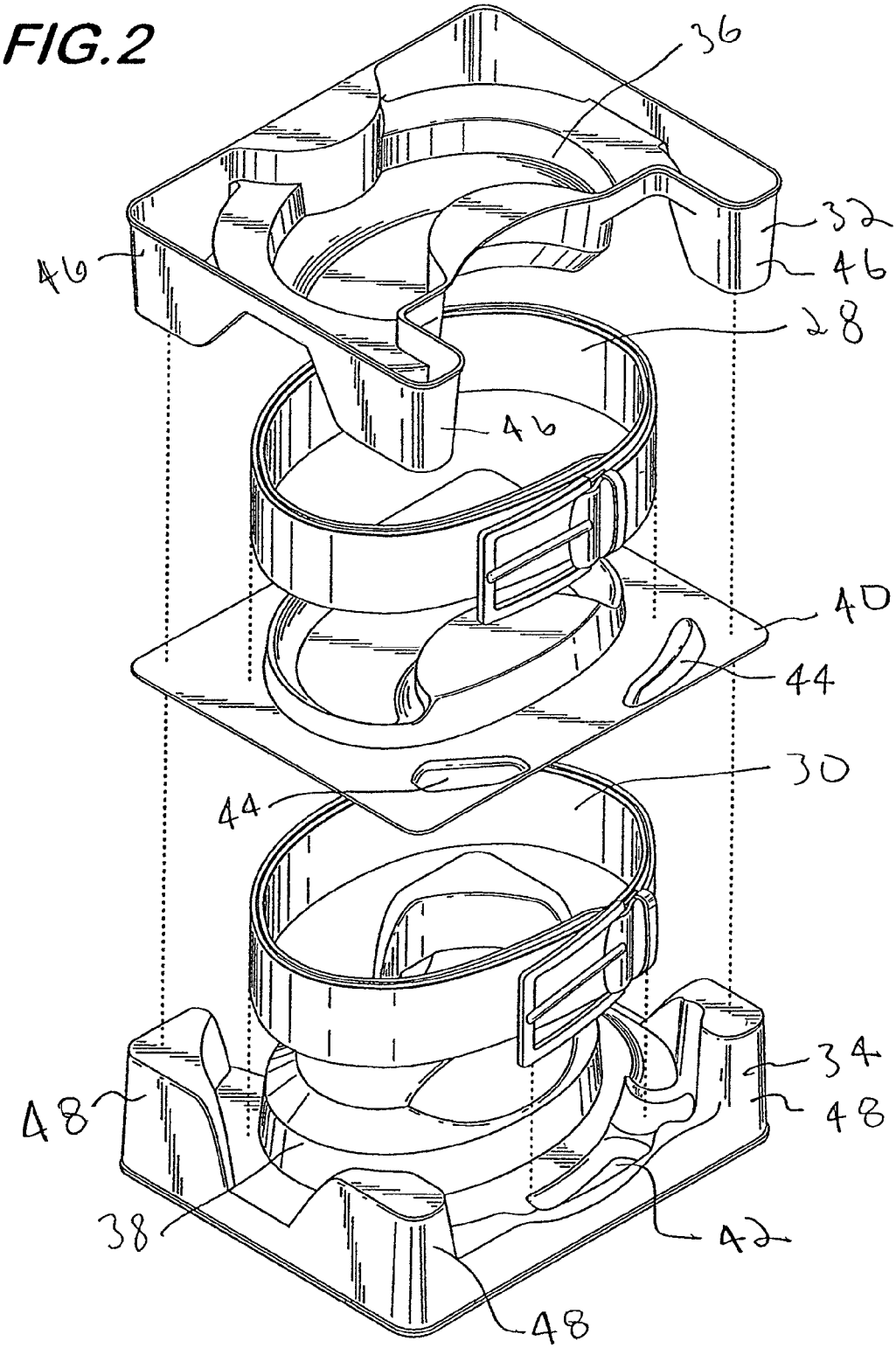
FIG. 2 is an exploded isometric view of the box for the sale of belts of FIG. 1.
Figure 3:
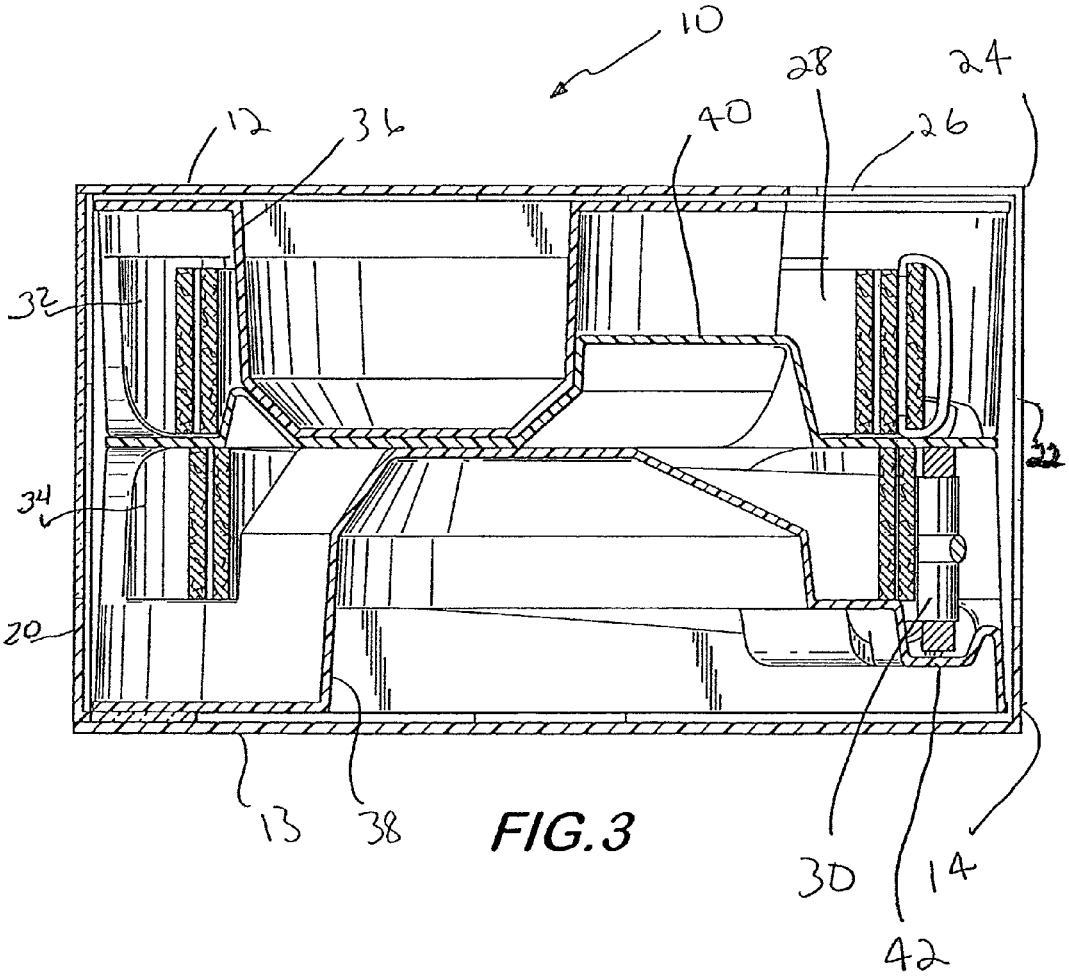
FIG. 3 is a left side elevation view of the box for the sale of belts of FIG. 1, taken substantially along lines 3--3 of FIG. 1.
Figure 4:
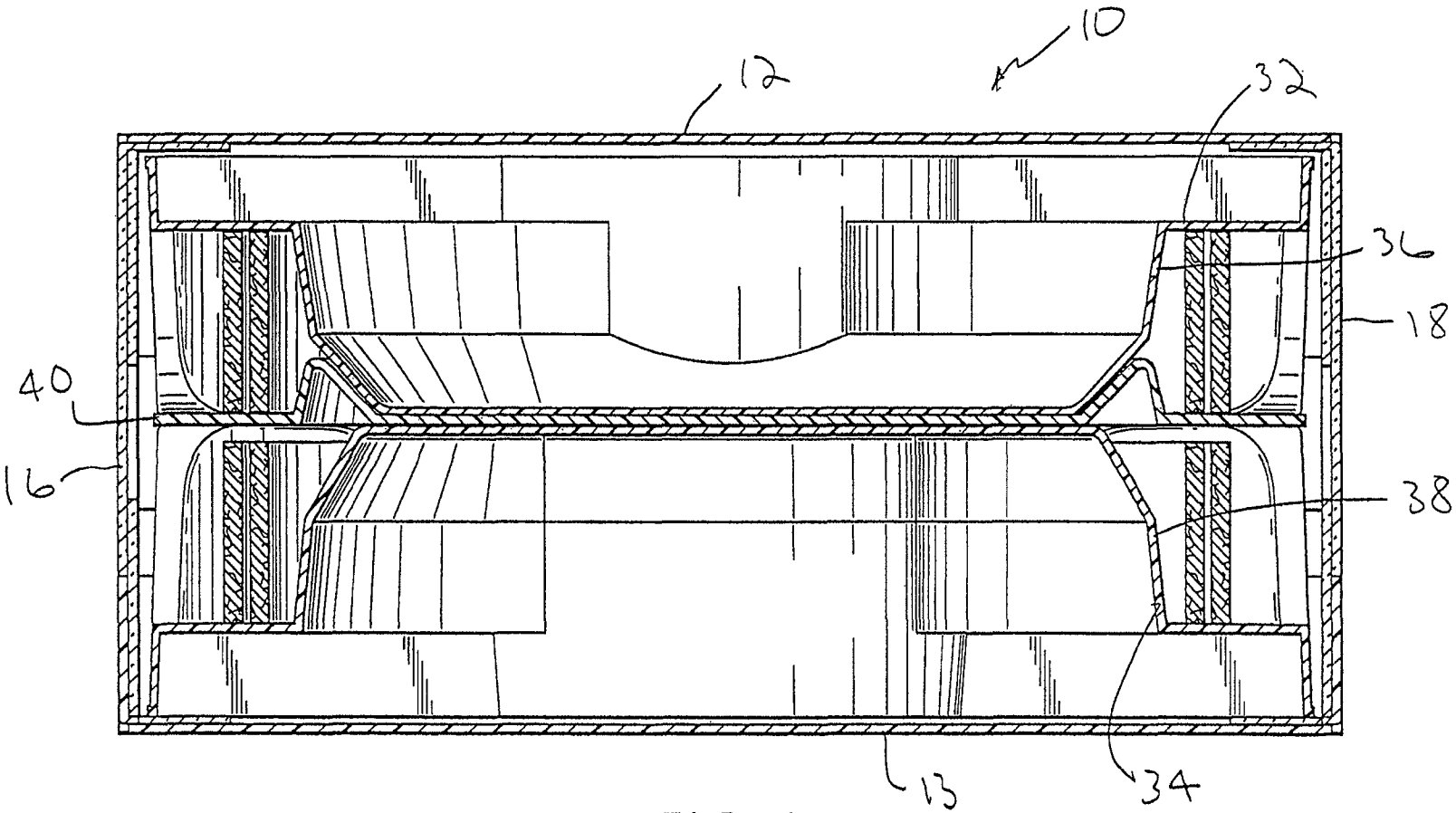
FIG. 4 is a rear side elevation view of the box for a pair of belts of FIG. 1, taken substantially along lines 4--4 of FIG. 1.

Referring now to the accompanying drawings, wherein like reference numbers refer to like elements throughout the several views, there is shown in FIGS. 1-4 a box for a pair of belts 10 in accordance with a preferred embodiment of the present invention. The box for a pair of belts includes a top wall 12, a bottom wall 13, and side walls 14, 16, 18 and 20 disposed between the top wall 12 and the bottom wall 13. An aperture 22 on at least one of the side walls 14, 16, 18 or 20 extends to an edge 24 thereof, contiguous with an aperture 26 in the top wall 12 to expose a portion of at least one belt of the pair of belts 28, 30. At least one of the pair of belts 28, 30 is exposed for a user to feel through the aperture 22 in the side wall 14 (or, optionally 16, 18 or 20) and the aperture 26 in the top wall 12.

An upper formed spacer 32 and a lower formed spacer 34 may be provided to support the belts 28, 30. The upper formed spacer 32 may have a raised protuberance 36 to support an upper belt 28 of the pair of belts in a coiled condition. The lower formed spacer 34 may have a raised protuberance 38 to support a lower belt 30 of the pair of belts in a coiled condition.

A middle formed spacer 40 may be disposed in the box 10 between the upper formed spacer 32 and the lower formed spacer 34 to separate the upper belt 28 from the lower belt 30. A depression 42, formed in the lower formed spacer 34, may be included to fit a buckle 30A of the lower belt 30.

At least one raised protuberance 44 may be included in the middle formed spacer 34 to assist in preventing the lower belt 30 from uncoiling while in the package. The upper formed spacer 32 may have raised corner members 46 and the lower formed spacer 34 may have raised corner members 48. The raised corner members 46 of the upper formed spacer 32 abut the middle formed spacer 40 and the raised corner members 48 of the lower formed spacer 34 abut the middle formed spacer 40.

All or a portion of the box 10, including the top wall 12, bottom wall 13, side walls 14, 16, 18, 20 and upper and lower formed spacers 32, 34 and middle formed spacers 40 are preferably made from a plastic film that is transparent 16A or opaque 16B, as is well known. However, substantially any type of suitable material may be used including, for example, paper, cardboard and the like. The box 10 may be sealed closed with a film having adhesive thereon or similar means such that a potential buyer can view the box 10 and actually touch the belt strap and buckle 28A, 30A of at least one of the belts 28, 30, without removing the belts from the box.

A plurality of such boxes 10 may be stacked on a pallet to be moved by, for example, a fork lift, into a warehouse store for display directly on the pallet.

While the invention has been described in detail and with reference to specific embodiments thereof, it will be apparent to one skilled in the art that various changes and modifications can be made therein without departing from the spirit and scope thereof.

What is claimed is:

1. A box for a pair of belts, comprising:

(a) a top wall;

(b) a bottom wall;

(c) a plurality of side walls disposed between the top wall and the bottom wall;

(d) an aperture on at least one of the side walls extending to an edge thereof, contiguous with an aperture in the top wall to expose a portion of the at least one belt of the pair of belts;

(e) an upper formed spacer and a lower formed spacer, said upper formed spacer having a raised protuberance to support an upper belt of the pair of belts in a coiled condition, said lower formed spacer having a raised protuberance to support a lower belt of the pair of belts in a coiled condition; and (f) a depression formed in the lower formed spacer to fit a buckle of the lower belt;

whereby at least one of the pair of belts is exposed for a user to feel through said aperture in the side wall and said aperture in the top wall.

2. A box for a pair of belts, comprising:

(a) a top wall;

(b) a bottom wall;

(c) a plurality of side walls disposed between the top wall and the bottom wall;

(d) an aperture on at least one of the side walls extending to an edge thereof, contiguous with an aperture in the top wall to expose a portion of the at least one belt of the pair of belts;

(e) an upper formed spacer and a lower formed spacer, said upper formed spacer having a raised protuberance to support an upper belt of the pair of belts in a coiled condition, said lower formed spacer having a raised protuberance to support a lower belt of the pair of belts in a coiled condition;

(f) a middle formed spacer, disposed in the box between the upper formed spacer and the lower formed spacer to separate the upper belt from the lower belt; and (g) at least one raised protuberance in the middle formed spacer to assist in preventing the lower belt from uncoiling, whereby at least one of the pair of belts is exposed for a user to feel through said aperture in the side wall and said aperture in the top wall.

3. A box for a pair of belts, comprising:

(a) a top wall;

(b) a bottom wall, (c) a plurality of side walls disposed between the top wall and the bottom wall;

(d) an aperture on at least one of the side walls extending to an edge thereof, contiguous with an aperture in the top wall to expose a portion of the at least one belt of the pair of belts;

(e) an upper formed spacer and a lower formed spacer, said upper formed spacer having a raised protuberance to support an upper belt of the pair of belts in a coiled condition, said lower formed spacer having a raised protuberance to support a lower belt of the pair of belts in a coiled condition, (f) a middle formed spacer, disposed in the box between the upper formed spacer and the lower formed spacer to separate the upper belt from the lower belt; and (g) wherein the upper formed spacer and the lower formed spacer each have a plurality of raised corner members, wherein the raised corner members of the upper formed spacer abut the middle formed spacer and the raised corner members of the lower formed spacer abut the middle formed spacer;

whereby at least one of the pair of belts is exposed for a user to feel through said aperture in the side wall and said aperture in the top wall.

4. A box for a pair of belts, comprising:

(a) a top wall;

(b) a bottom wall;

(c) a plurality of side walls disposed between the top wall and the bottom wall;

(d) an aperture on at least one of the side walls extending to an edge thereof contiguous with an aperture in the top wall to expose a portion at least one belt of the pair of belts;

(e) an upper formed spacer and a lower formed spacer, said upper formed spacer having a raised protuberance to support an upper belt of the pair of belts in a coiled condition, said lower formed spacer having a raised protuberance to support a lower belt of the pair of belts in a coiled condition; and (f) wherein the upper formed spacer and the lower formed spacer each have a plurality of raised corner members, wherein the raised corner members of the upper formed spacer abut the middle formed spacer and the raised corner members of the lower formed spacer abut the middle formed spacer;

whereby at least one of the pair of belts is exposed for a user to feel through said aperture in the side wall and said aperture in the top wall.

5. The box for a pair of belts of claim 4, including a middle formed spacer, disposed in the box between the upper formed spacer and the lower formed spacer to separate the upper belt from the lower belt.

6. The box for a pair of belts of claim 4, including a depression formed in the lower formed spacer to fit a buckle of the lower belt.

7. The box for a pair of belts of claim 4, including at least one raised protuberance in the lower formed spacer to assist in preventing the lower belt from uncoiling.

* * * * *